US007766219B2

(12) United States Patent
Gomes et al.

(10) Patent No.: US 7,766,219 B2
(45) Date of Patent: Aug. 3, 2010

(54) CARTON WITH CURVED END AND DISPENSING FEATURES

(75) Inventors: Jean-Manuel Gomes, Marietta, GA (US); Raymond Rudolph Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 888 days.

(21) Appl. No.: 11/533,090

(22) Filed: Sep. 19, 2006

(65) Prior Publication Data

US 2007/0069002 A1 Mar. 29, 2007

Related U.S. Application Data

(60) Provisional application No. 60/720,010, filed on Sep. 23, 2005.

(51) Int. Cl.

| | |
|---|---|
| ***B65D 5/00*** | (2006.01) |
| ***B65D 3/00*** | (2006.01) |
| ***B65D 3/26*** | (2006.01) |
| ***B65D 17/00*** | (2006.01) |
| ***B65D 65/00*** | (2006.01) |
| ***B65D 75/00*** | (2006.01) |

(52) U.S. Cl. ..... 229/122; 229/121; 229/242; 229/107; 229/201; 229/182.1; 206/427; 206/430; 220/906

(58) Field of Classification Search ..... 229/122, 229/107, 201, 182.1, 242, 121; 206/427, 206/430; 220/906

See application file for complete search history.

(56) References Cited

U.S. PATENT DOCUMENTS

| | | | | |
|---|---|---|---|---|
| 2,115,673 A | | 4/1938 | Stompe | |
| 2,800,224 A | * | 7/1957 | Taylor et al. | 206/427 |
| 3,178,242 A | | 4/1965 | Ellis et al. | |
| 3,356,279 A | | 12/1967 | Root | |
| 3,807,624 A | * | 4/1974 | Funkhouser | 206/427 |
| 3,894,681 A | | 7/1975 | Arneson et al. | |
| 4,396,143 A | | 8/1983 | Killy | |
| 4,417,655 A | | 11/1983 | Forbes, Jr. | |
| 4,577,762 A | | 3/1986 | Kuchenbecker | |
| 4,890,440 A | | 1/1990 | Romagnoli | |
| 4,949,845 A | | 8/1990 | Dixon | |
| 4,974,771 A | | 12/1990 | Lavery | |
| 5,137,211 A | | 8/1992 | Summer et al. | |
| 5,246,112 A | | 9/1993 | Stout et al. | |

(Continued)

FOREIGN PATENT DOCUMENTS

| | | |
|---|---|---|
| DE | 1192099 | 4/1965 |

(Continued)

*Primary Examiner*—Gary E Elkins
*Assistant Examiner*—Latrice Byrd
(74) *Attorney, Agent, or Firm*—Womble Carlyle Sandridge & Rice, PLLC

(57) ABSTRACT

A carton for containing a plurality of articles. The carton has panels that extend at least partially around an interior of the carton. The panels comprise a top panel, a bottom panel and a first side panel and a second side panel. The carton has a dispenser for allowing access to the articles in the carton. The dispenser has a dispenser panel that is at least partially defined by a tear line in the carton and is for being at least partially removed for at least further opening a dispenser opening. The carton can also have a curved end.

25 Claims, 7 Drawing Sheets

U.S. PATENT DOCUMENTS

| | | | | |
|---|---|---|---|---|
| 5,505,372 | A | 4/1996 | Edson et al. | |
| 5,622,309 | A | 4/1997 | Matsuda et al. | |
| 5,664,683 | A | 9/1997 | Brody | |
| 5,690,213 | A | 11/1997 | Matsumura | |
| 5,704,470 | A | 1/1998 | Sutherland | |
| 5,826,783 | A | 10/1998 | Stout | |
| 5,875,961 | A | 3/1999 | Stone et al. | |
| 5,921,398 | A | 7/1999 | Carroll | |
| 5,924,559 | A | 7/1999 | Carrel et al. | |
| 6,155,480 | A * | 12/2000 | Botsford et al. | 229/122.1 |
| 6,176,419 | B1 | 1/2001 | Holley, Jr. | |
| 6,409,077 | B1 | 6/2002 | Telesca et al. | |
| 6,631,803 | B2 | 10/2003 | Rhodes et al. | |
| 6,715,639 | B2 | 4/2004 | Spivey | |
| 6,752,262 | B1 | 6/2004 | Boriani et al. | |
| 6,866,186 | B2 | 3/2005 | Fogle et al. | |
| 7,000,803 | B2 * | 2/2006 | Miller | 221/302 |
| 7,237,674 | B2 * | 7/2007 | Auclair | 206/427 |
| 2002/0070139 | A1 | 6/2002 | Bates | |
| 2002/0088820 | A1 | 7/2002 | Spivey | |
| 2002/0088821 | A1 | 7/2002 | Spivey et al. | |
| 2003/0192905 | A1 | 10/2003 | Spivey | |
| 2004/0060972 | A1 | 4/2004 | Harrelson | |
| 2004/0099558 | A1 | 5/2004 | Oliff et al. | |
| 2004/0164133 | A1 | 8/2004 | Harrelson | |
| 2004/0188277 | A1 | 9/2004 | Auclair | |
| 2005/0178687 | A1 | 8/2005 | Spivey, Sr. | |
| 2005/0178791 | A1 | 8/2005 | Miller | |
| 2006/0000881 | A1 * | 1/2006 | Sutherland | 229/242 |
| 2006/0108406 | A1 * | 5/2006 | Stewart et al. | 229/122.1 |
| 2006/0254942 | A1 * | 11/2006 | Cargile, Jr. | 206/427 |

FOREIGN PATENT DOCUMENTS

| | | | |
|---|---|---|---|
| EP | 0 475 147 | A1 | 6/1992 |
| EP | 1 262 417 | A2 | 12/2002 |
| FR | 2 549 010 | A1 | 1/1985 |
| FR | 2 581 970 | | 11/1986 |
| WO | WO 96/29260 | | 9/1996 |
| WO | WO 99/64301 | | 12/1999 |
| WO | WO 02/30785 | A1 | 4/2002 |
| WO | WO 03/082686 | | 10/2003 |
| WO | WO 2004/043790 | A2 | 5/2004 |

* cited by examiner

CARTON WITH CURVED END AND DISPENSING FEATURES

CROSS-REFERENCE TO RELATED APPLICATIONS

This application claims the benefit of U.S. Provisional Application No. 60/720,010, filed on Sep. 23, 2005, the entire contents of which are hereby incorporated by reference as if presented herein in their entirety.

BACKGROUND OF THE INVENTION

The present invention generally relates to cartons for holding and dispensing beverage containers or other types of articles. More specifically, the present invention relates to cartons having a dispenser with various features as well as a carton having a curved end profile.

Cartons, such as paperboard cartons used to hold, carry or dispense articles, are well known. These cartons usually are formed or assembled by folding a paperboard carton blank that has been cut, perforated and creased in selected areas to achieve desired features and characteristics. These features include tear lines, handles, opening features, dispensers and other well-known attributes.

When fabricating a carton from the paperboard carton blank, opposite ends of the blank typically are attached to each other by glue or by mechanical locks to form the bottom panel of the carrier. End flaps are included on sides of some or all panels and are folded inwardly to close the ends of the carton and enclose articles, such as beverage containers, therewithin. These end flaps can contain opening or dispensing features or can include handles for carrying the carton. Existing dispensing features allow access to containers in the carton but often do not prevent the containers from unintentional removal from the carton. Further, at least many existing cartons are not shaped to accommodate containers arranged in asymmetrical rows including at least two rows having different quantities of containers.

SUMMARY OF THE INVENTION

In general, one aspect of the invention is directed to a carton for containing a plurality of articles. The carton comprises a plurality of panels that extend at least partially around an interior of the carton. The plurality of panels comprise a top panel, a bottom panel, a first side panel, and a second side panel. At least two end flaps are respectively foldably attached to respective panels of the plurality of panels, wherein the end flaps are overlapped with respect to one another and thereby at least partially form a closed end of the carton. The first side panel and second side panel have respective curved edge portions at the closed end.

In another aspect, the invention is generally directed to a blank for forming a carton. The blank comprises a plurality of panels comprising a top panel, a bottom panel, a first side panel, and a second side panel. At least two end flaps are respectively foldably attached to respective panels of the plurality of panels, wherein the end flaps are for being overlapped with respect to one another to thereby at least partially form a closed end of a carton formed from the blank. The first side panel and second side panel have respective curved edge portions at an end of the blank.

In yet another aspect, the invention is generally directed to a carton for containing a plurality of articles. The carton comprises a plurality of panels that extend at least partially around an interior of the carton. The plurality of panels comprise a top panel, a bottom panel, a first side panel, and a second side panel. At least two end flaps are respectively foldably attached to respective panels of the plurality of panels, wherein the end flaps are overlapped with respect to one another and thereby at least partially close an end of the carton. A dispenser in the end of the carton allows removal of articles from the carton. The dispenser comprises a dispenser panel that is at least partially defined by a tear line in the carton and is for being at least partially removed for at least further opening a dispenser opening. In at least one of the end flaps, the tear line forms a generally L-shaped portion for at least partially retaining the articles at the end of the carton.

In still another aspect, the invention is generally directed to a blank for forming a carton. The blank comprises a plurality of panels comprising a top panel, a bottom panel, a first side panel, and a second side panel. At least two end flaps are respectively foldably attached to respective panels of the plurality of panels. A dispenser panel is at least partially defined by a tear line in the blank in each of the end flaps. The tear line forms a generally L-shaped portion.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., plastic beverage bottles) as disposed within the carton embodiments. In this specification, the terms "lower," "bottom," "upper" and "top" indicate orientations determined in relation to fully erected and upright cartons.

Figure 1:
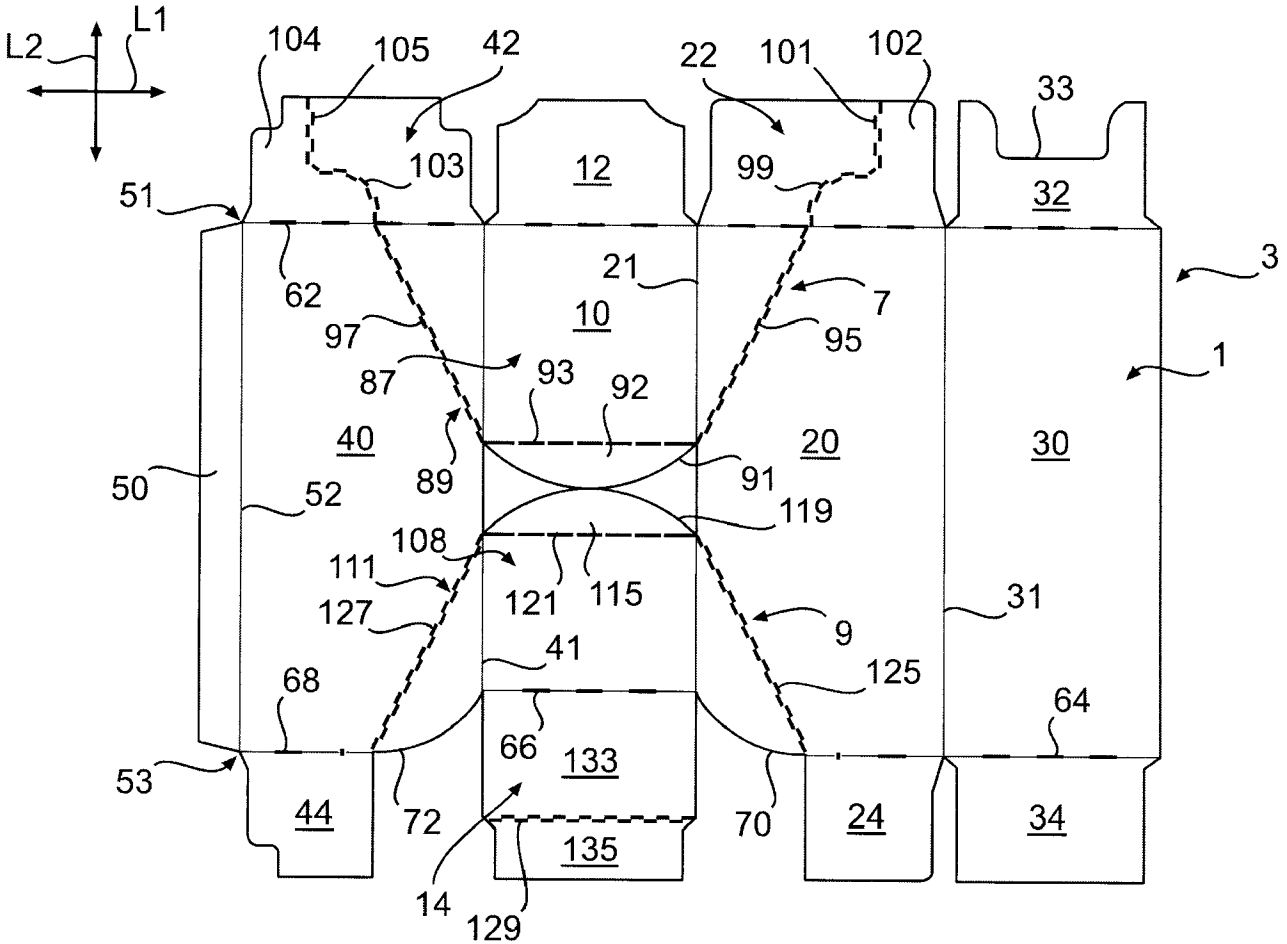
FIG. 1 is a plan view of a blank used to form a carton according to a first embodiment of the invention.
Figure 2:
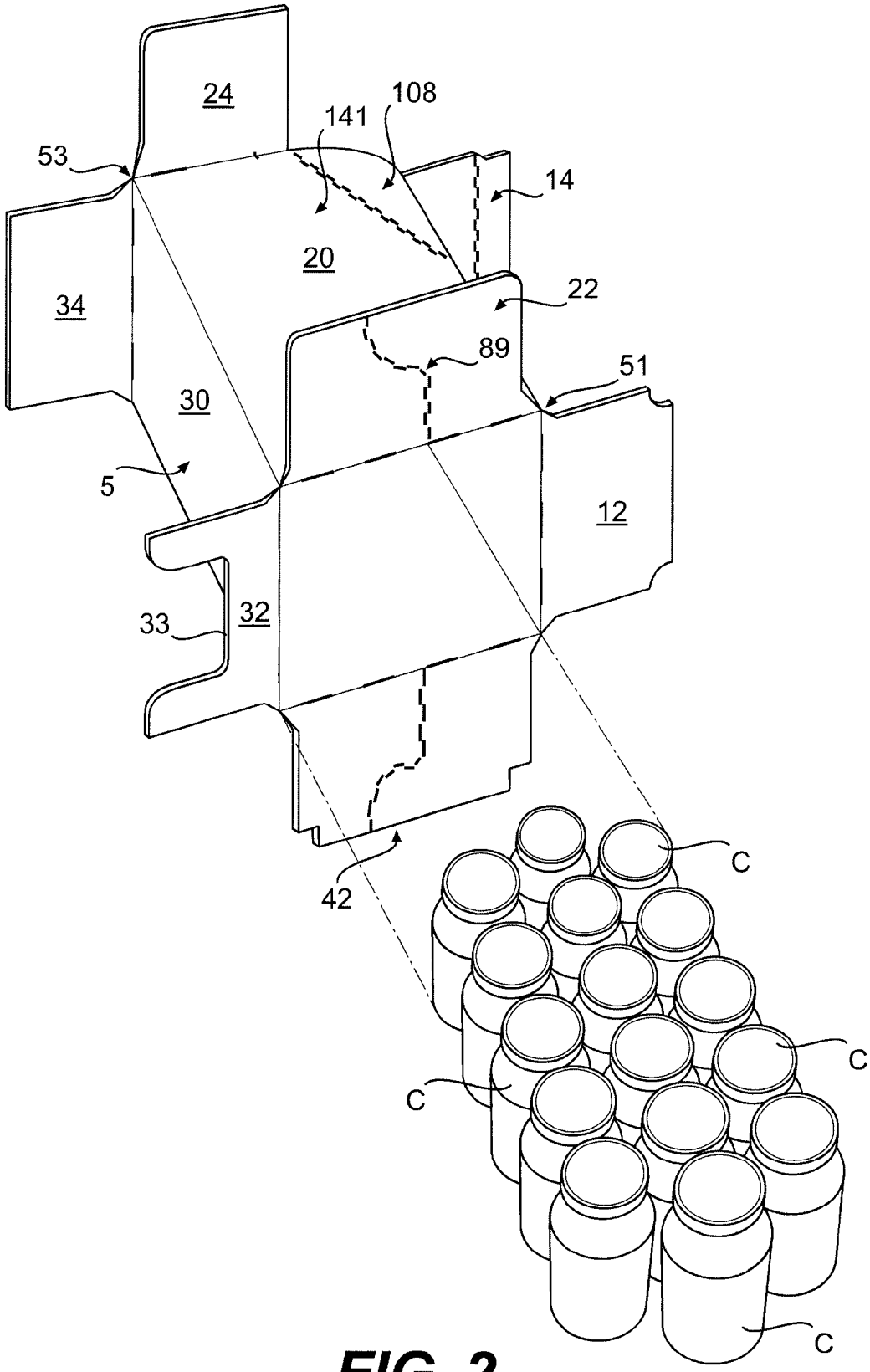
FIG. 2 is a schematic perspective of the carton partially assembled with two open ends and containers positioned for insertion into the carton.

FIG. 1 is a plan view of the exterior side 1 of a blank, generally indicated at 3, used to form a carton 5 (FIGS. 2-11) according to the exemplary embodiment of the invention. The carton 5 can be used to house a plurality of articles such as containers C (FIG. 2). As best shown in FIG. 2, the carton 5 is sized to house sixteen containers C in a single layer arranged in three rows in a staggered, asymmetrical arrangement including three rows with the two outer rows having five containers and the middle row having six containers. It is understood that the carton 5 may be sized and shaped to hold containers of a different or same quantity in more than one layer and/or in different row/column arrangements. Such alternative arrangements may be asymmetrical or symmetrical (i.e., having the same quantity of containers per row) without departing from the scope of this invention. The present invention can also be used in cartons that include various unique features, including opening features that provide easy access to the articles, tilt features that position the articles at the front end of the carton, and handle features.

The blank 3 has a longitudinal axis L1 and a lateral axis L2. In the illustrated embodiment, the blank 3 comprises a top panel 10 foldably connected to a first side panel 20 at a first lateral fold line 21, a bottom panel 30 foldably connected to the first side panel 20 at a second lateral fold line 31, and a second side panel 40 foldably connected to the top panel 10 at a third lateral fold line 41. In the illustrated embodiment, the blank 3 includes an adhesive flap 50 foldably connected to the second side panel 40 at a fourth lateral fold line 52.

The top panel 10 is foldably connected to a first top end flap 12 and a second top end flap 14. The first side panel 20 is foldably connected to a first side flap 22 and a second side flap 24. The bottom panel 30 is foldably connected to a first bottom end flap 32 and a second bottom end flap 34. The first bottom end flap 32 has a generally U-shaped cutout 33, and the second bottom end flap 34 is generally rectangular-shaped. The second side panel 40 is foldably connected to a first side flap 42 and a second side flap 44. When the carton 5 is erected, the top and bottom end flaps 12 and 32 and side end flaps 22 and 42 close a first end 51 of the carton, and the top and bottom end flaps 14 and 34 and side end flaps 24 and 44 close a second end 53 of the carton. In accordance with an alternative embodiment of the present invention, different flap arrangements can be used for closing the ends 51, 53 of the carton 5.

The top and bottom end flaps 12 and 32 and side end flaps 22 and 42 extend along a first marginal area of the blank 3, and are foldably connected at a first longitudinal fold line 62 that extends lengthwise of the blank. The top and bottom end flaps 14 and 34 and side end flaps 24 and 44 extend along a second marginal area of the blank 3. The side end flap 24 and bottom end flap 34 are respectively foldably connected to the blank 3 at a second longitudinal fold line 64 that extends lengthwise of the blank along the edge of the bottom panel 30 and a portion of the edge of the first side panel 20 at the second end 53. The top end flap 14 is foldably connected to the top panel 10 at a longitudinal fold line 66 that extends along the edge of the top panel at the second end 53 of the blank 3. The side end panel 44 is foldably connected to the second side panel 40 along a longitudinal fold line 68 that extends along a portion of the edge of the second side panel at the second end 53 of the blank 3. In the illustrated embodiment, the longitudinal fold line 66 is spaced laterally inward from the longitudinal fold lines 64, 68 at the second end 53 of the blank 3. The longitudinal fold lines 62, 64, 66, 68 may be otherwise positioned and may be, for example, substantially straight, offset at one or more locations to account for blank thickness or for other factors, curved, or oblique without departing from this invention.

In the illustrated embodiment, the first side end panel 20 includes a curved edge 70 at the second end 53 between the longitudinal fold line 64 and the longitudinal fold line 66. The second end panel 40 has a curved edge 72 at the second end 53 between the longitudinal fold line 68 and the longitudinal fold line 66. The curved edges 70, 72 of the side panels 20, 40 could be otherwise shaped and positioned and that the side panels could have straight edges without departing from the scope of this invention. Further, the edges of the side panels 20, 40 at the first end 51 of the blank 3 may be curved or alternatively shaped without departing from the scope of this invention.

The carton 5 has a first dispenser, generally indicated at 7, formed in the carton 5 for allowing access to the containers C from the first end 51. The dispenser 7 includes a dispenser panel 87 formed in the top panel 30, side panels 20, 40 and side flaps 22, 42. The dispenser panel 87 is separable from the carton 5 along a tear line, generally indicated at 89, to form an opening 88 (FIG. 9) in the carton. The dispenser 7 includes a finger panel 92 in the top panel 10 that is foldable along a curved fold line 91 for grasping of the dispenser panel 87. The tear line 89 includes a first portion 93 in the top panel 10 that extends between the lateral fold lines 21, 41 and connects respective ends of the curved fold line 91 to define the finger panel 92. The tear line 89 has a second portion 95 in the first side panel 20 that extends generally obliquely from the lateral fold line 21 to the longitudinal fold line 62. The tear line 89 has a third portion 97 in the second side panel 40 extending generally obliquely from the lateral fold line 41 to the longitudinal fold line 62. The tear line 89 has a fourth portion 99 that is curved and extends from the intersection of the second portion 95 with the longitudinal fold line 62 into the side end panel 22. A fifth portion 101 of the tear line 89 extends generally laterally from the curved portion 99 to the edge of the side end panel 22. The fourth and fifth portions 99, 101 of the tear line 89 form a retaining portion 102 in the side end panel 22 that is generally L-shaped. A sixth portion 103 and seventh portion 105 of the tear line 89 are shaped similarly to the fourth and fifth portions 99, 103 and form an L-shaped retaining portion 104 in the side end panel 42 that is shaped generally similar to the retaining portion 102 in the side end panel 22.

In the illustrated embodiment, the carton 5 has a second dispenser, generally indicated at 9, formed in the carton 5 for allowing access to the containers C from the second end 53. The dispenser 9 includes a dispenser panel 108 formed in the top panel 10, side panels 20, 40 and top end flap 14. The dispenser panel 108 is separable from the carton 5 along a tear line, generally indicated at 111, to form an opening 113 (FIGS. 10 and 11) in the carton. The dispenser 9 includes a finger panel 115 in the top panel 10 that is foldable along a curved fold line 119 for grasping of the dispenser panel 108. The tear line 111 includes a first portion 121 in the top panel 10 that extends between the lateral fold lines 21, 41 and connects respective ends of the curved fold line 119 to define the finger panel 115. The tear line 111 has a second portion 125 in the first side panel 20 that extends generally obliquely from the lateral fold line 21 to the longitudinal fold line 64. The tear line 111 has a third portion 127 in the second side panel 40 extending generally obliquely from the lateral fold line 41 to the longitudinal fold line 68. The tear line 111 has a fourth portion 129 that extends longitudinally between the opposed longitudinal ends of the top end flap 14. The fourth portion 129 divides the top end flap 14 into an upper portion 133 that is part of the dispenser panel 108 and a lower portion 135 that remains attached to the side end flaps 24, 44 and bottom end flap 34 at the closed end 53 of the carton 5. Upon removal of the dispenser panel 108 (FIG. 11), the lower portion 135 of the top end flap and the side end flaps 24, 44 and bottom end flap 34 comprise a retaining portion 139 of the dispenser 9.

In accordance with the exemplary embodiment, the blank 3 can be erected into the carton 5 by folding along fold lines 21, 31, 41, and 52 and adhering the adhesive flap 50 to the bottom panel 30 to form a sleeve 141 (FIG. 2). The blank 3 may be otherwise configured to have multiple top panels and/or multiple bottom panels without departing from the scope of this invention. Once the blank 3 is assembled into the sleeve 141, the containers C are loaded into the interior of the sleeve 141 from the first end 51. Alternative methods of forming the sleeve 141 and loading the containers C may be utilized without departing from the scope of this invention.

Figure 3:
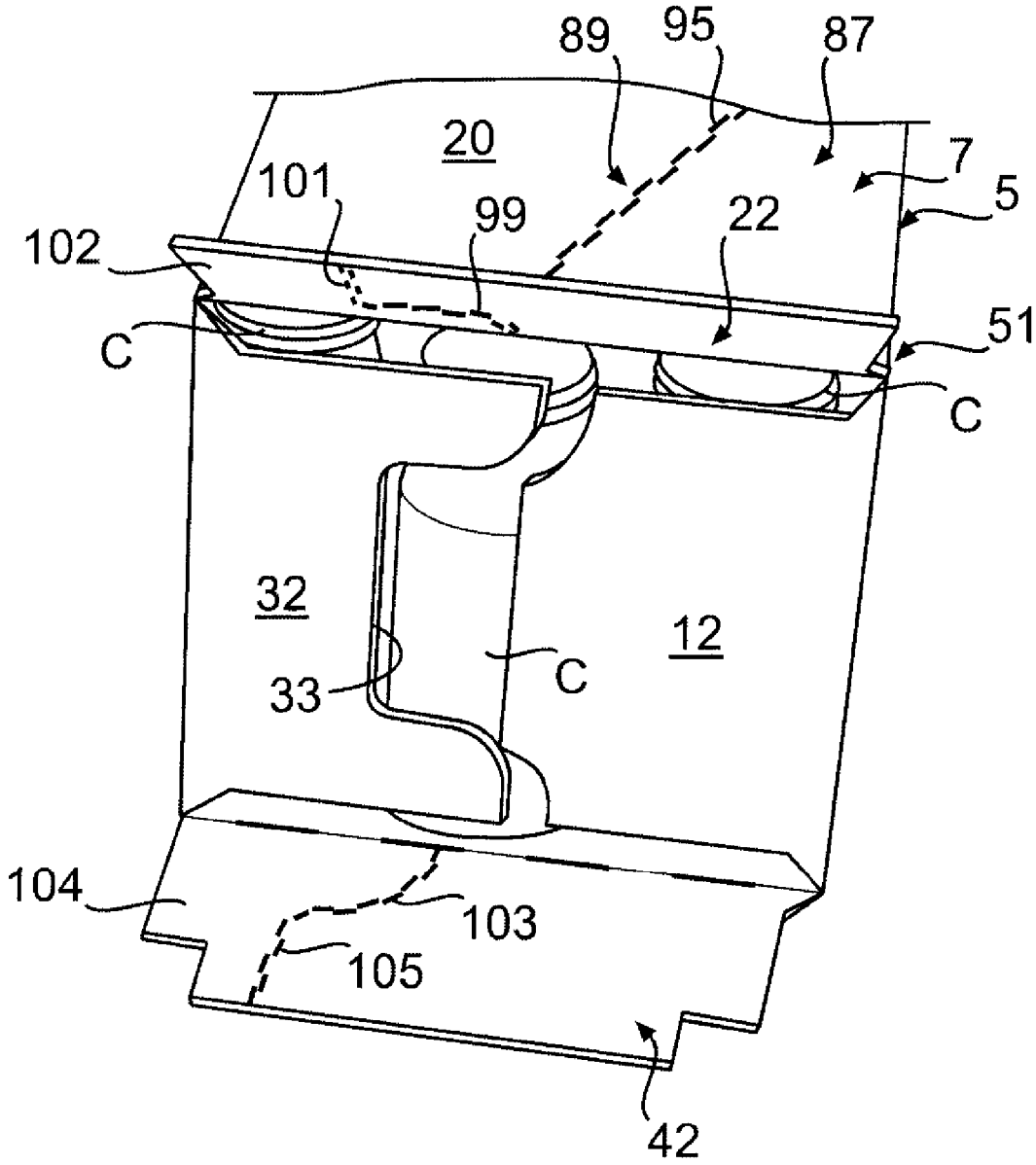
FIG. 3 is a perspective of a first end of the carton partially closed.
Figure 4:
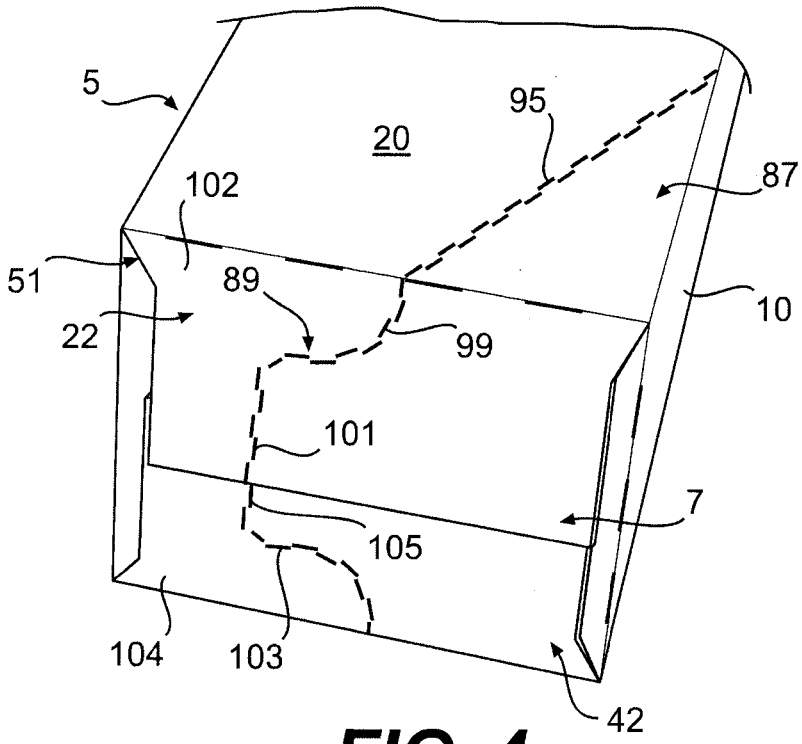
FIG. 4 is a view similar to FIG. 3 but showing the first end fully closed.
Figure 5:
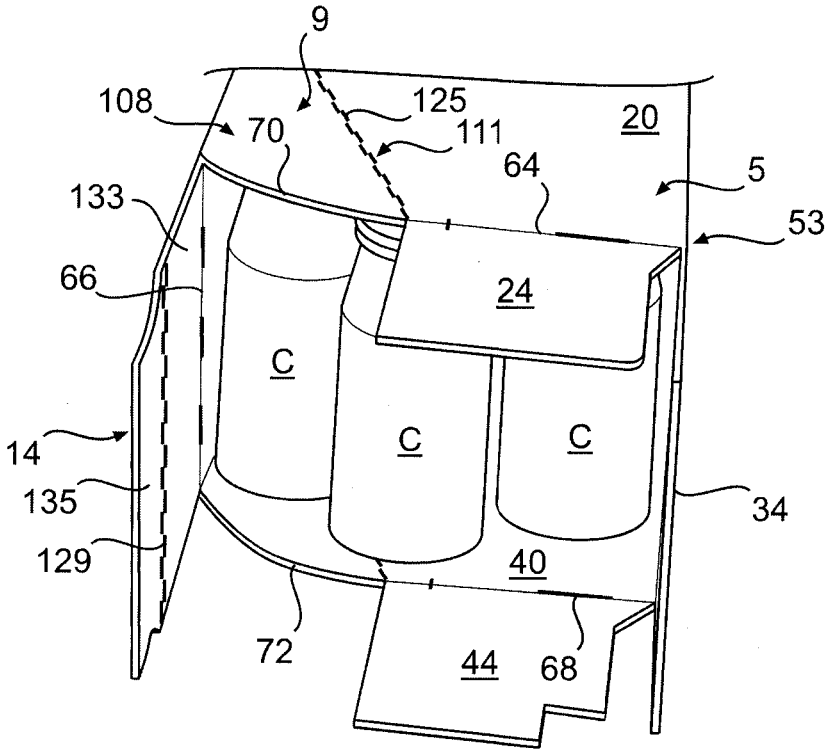
FIG. 5 is a detail perspective of a second open end of the carton.
Figure 6:
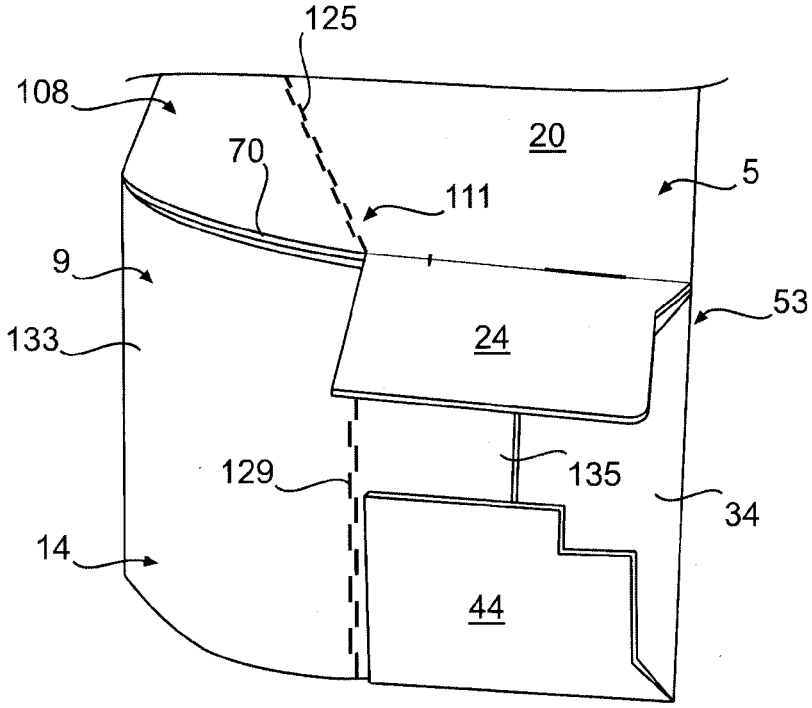
FIG. 6 is a view similar to FIG. 5 but showing the second end partially closed.
Figure 7:
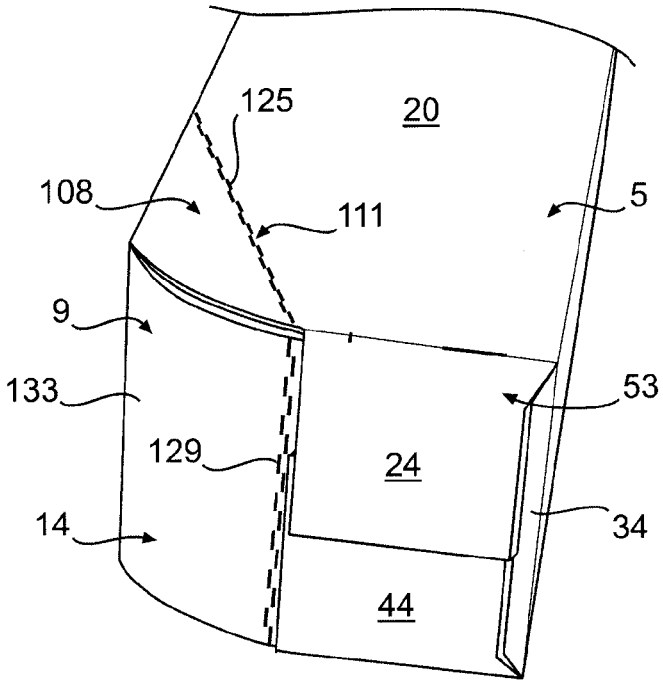
FIG. 7 is a view similar to FIG. 6 but showing the second end fully closed.

After the containers C are inserted into the carton, the first end 51 of the carton 5 is closed by respectively overlapping and adhering the top and bottom end flaps 12, 32 and the side end flaps 12, 22 (FIGS. 3 and 4). The second end 53 of the carton 5 is closed by respectively overlapping and adhering the top and bottom end flaps 14, 34 and the side end flaps 24, 44. In the illustrated embodiment, the top end flap 14 is closed by folding the end flap at the fold line 66 so that the upper portion 133 is curved to correspond with the shape of the spaced apart curved edge portions 70, 72 of respective side walls 20, 40. In the illustrated embodiment the side end flaps 24, 44 are overlapped and are adhered to the lower portion 135 of the top end panel 14 to form the retaining portion 139 at the end 53 of the carton 5.

Figure 8:
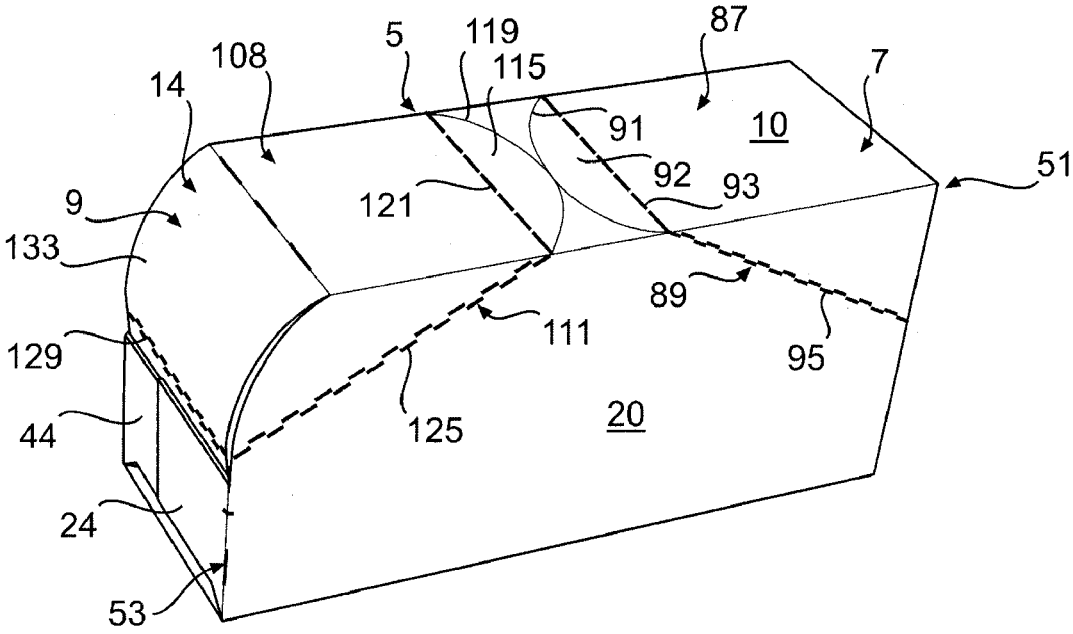
FIG. 8 is a perspective of the carton with the first and second ends closed and the carton positioned for dispensing the containers.

After closing the first and second ends 51, 53, the carton 5 is positioned as shown in FIG. 8 for dispensing of the containers C from either or both of the first and second dispensers 7, 9. In the illustrated embodiment, the dispenser panel 87 at the first closed end 51 of the carton 5 has a squared profile with a flat end wall being perpendicular to the top wall 10. The dispenser panel 108 at the second end 53 of the carton 5 has a curved profile with the top end flap 14 being folded downward to conform with the curved portions 72, 70 of the first and second side walls 20, 40.

Figure 9:
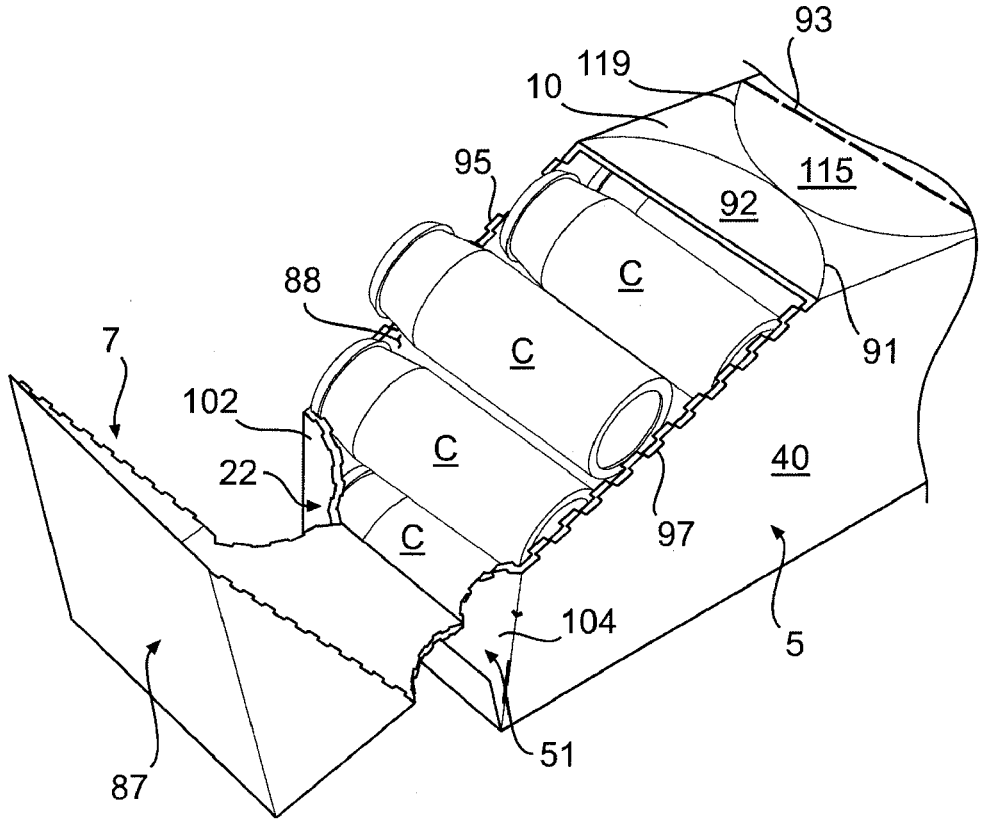
FIG. 9 is a view of the first end of the carton with a dispenser at the first end partially opened.

It is understood that the first dispenser 7 is opened by pressing the finger panel 92 inward to separate the dispenser panel 87 from the top panel 10 along the first portion 93 of the tear line 89. The dispenser panel 87 may be grasped and further torn along the tear line 89 to remove the dispenser panel and expose the containers C in the carton 5 (FIG. 9). Upon removal of the dispenser panel 87, the containers C are retained in the carton 5 by the retaining portions 102, 104 and the bottom end flap 32 having the U-shaped cutout 33. The dispenser panel 87 can be completely or partially removed from the carton 5 to allow access to the containers C. Further, the dispenser 7 may be otherwise sized, shaped, and/or located in the carton 5 without departing from the scope of this invention. Further, the dispenser 7 may be omitted from the carton 5 without departing from the scope of the invention.

Figure 10:
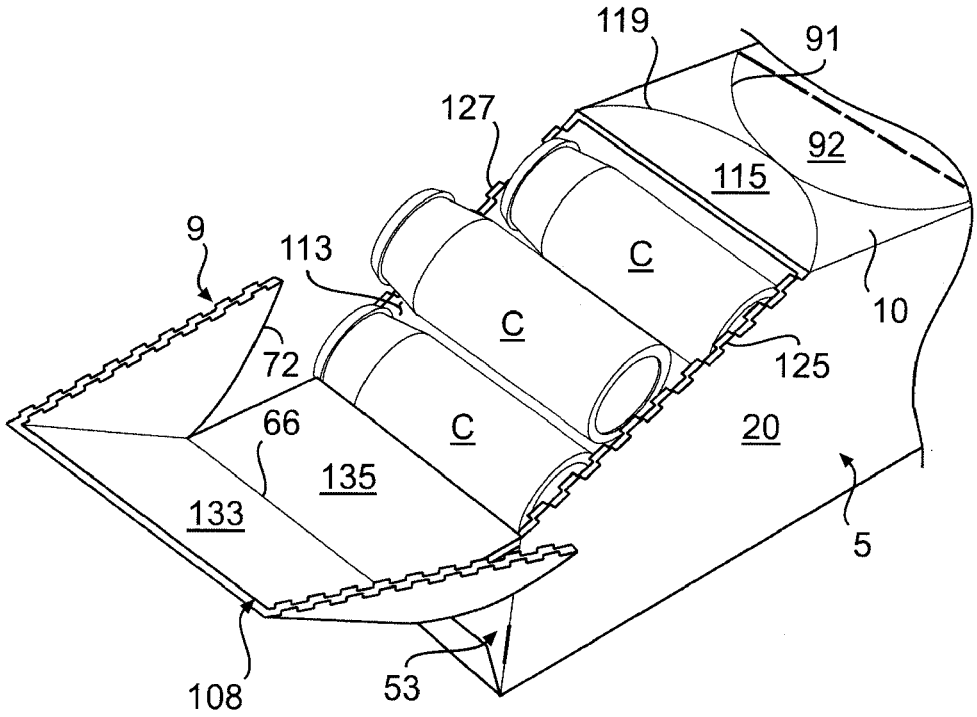
FIG. 10 is a view of the second end of the carton with a dispenser at the second end partially opened.
Figure 11:
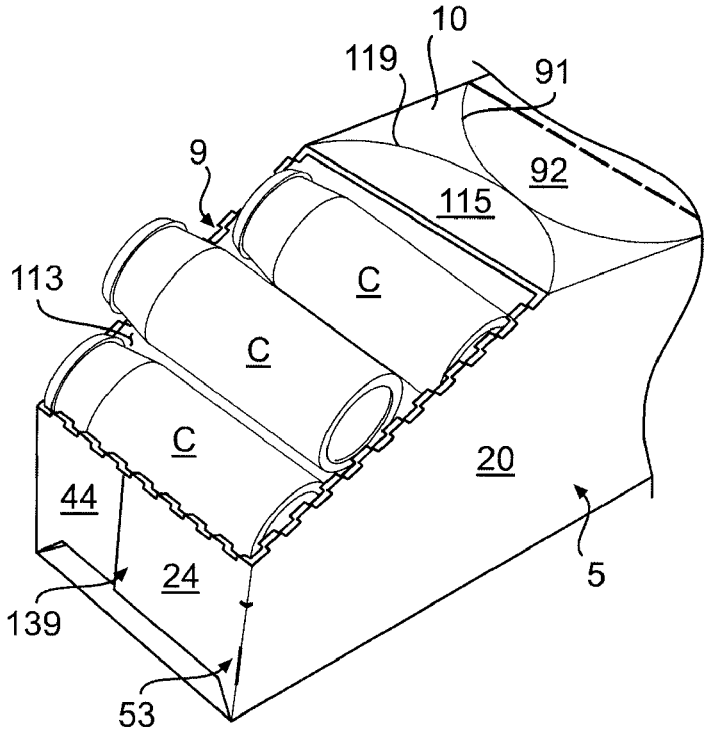
FIG. 11 is a view similar to FIG. 10 but with the dispenser at the second end fully opened.

It is understood that the second dispenser 9 is opened by pressing the finger panel 115 inward to separate the dispenser panel 108 from the top panel 10 along the first portion 121 of the tear line 111. The dispenser panel 115 may be grasped and torn along the tear line 111 to remove the dispenser panel and expose the containers C in the carton 5 (FIGS. 10 and 11). The dispenser panel 108 can be completely or partially removed from the carton 5 to allow access to the containers C. Further, the dispenser 9 may be otherwise sized, shaped, and/or located in the carton 5 without departing from the scope of this invention. Further, the dispenser 9 may be omitted from the carton 5 without departing from the scope of the invention.

Numerous advantages of the carton 5 disclosed herein include providing a dispenser 7 having a dispenser panel 87 that is shaped to allow access to the containers C in the carton and to include various retention features, including L-shaped retention panels 102, 104 in respective side end flaps 22, 42, that prevent the containers from falling out of the carton once the dispenser panel is removed. Also, the curved end profile of the carton 5 at the second end 53 allows the carton to more closely conform to the containers C when the container are arranged in rows having varying quantities and/or lengths. The features that provide the curved end 53, and thus the curved end, can be omitted without departing from the scope of this invention.

The blank 3 according to the present invention can be, for example, formed from coated paperboard and similar materials. For example, the interior and/or exterior sides of the blank 3 can be coated with a clay coating. The clay coating may then be printed over with product, advertising, price coding, and other information or images. The blank 3 may then be coated with a varnish to protect any information printed on the blank. The blank 3 may also be coated with, for example, a moisture barrier layer, on either or both sides of the blank. In accordance with the above-described embodiments, the blank 3 may be constructed of paperboard of a caliper such that it is heavier and more rigid than ordinary paper. The blank 3 can also be constructed of other materials, such as cardboard, hard paper, or any other material having properties suitable for enabling the carton 5 to function at least generally as described above. The blank 3 can also be laminated to or coated with one or more sheet-like materials at selected panels or panel sections.

In accordance with the above-described embodiments of the present invention, a fold line can be any substantially linear, although not necessarily straight, form of weakening that facilitates folding therealong. More specifically, but not for the purpose of narrowing the scope of the present invention, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like. For example, a cut line can be a continuous slit or could be wider than a slit without departing from the present invention.

The above embodiments may be described as having one or more panels adhered together by glue during erection of the carton embodiments. The term "glue" is intended to encompass all manner of adhesives commonly used to secure carton panels in place.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A carton for containing a plurality of articles, the carton comprising:

a plurality of panels that extends at least partially around an interior of the carton, the plurality of panels comprises a top panel, a bottom panel, a first side panel, and a second side panel;

at least two end flaps, each of the at least two end flaps being respectively foldably attached to a respective panel of the plurality of panels, wherein the end flaps are overlapped with respect to one another and thereby at least partially form a closed end of the carton, the at least two end flaps comprise a top end flap foldably attached to the top panel; and a dispenser in the closed end of the carton for removal of articles from the carton, the dispenser comprising a dispenser panel that is at least partially defined by a tear line in the carton and is for being at least partially removed for at least further opening a dispenser opening, the first side panel and second side panel having respective curved edge portions at the closed end, the top end flap having a curved portion with edges that are adjacent the curved edge portions of the first and second side panels to form a curved end profile at the closed end, the tear line comprising a tear line portion in the top end flap wherein the portion of the tear line in the top end flap extends across the edges of the top end flap and is generally perpendicular to the edges of the top end flap.

2. The carton of claim 1 wherein the at least two end flaps comprise a first side end flap foldably attached to the first side panel and a second side end flap foldably attached to the second side panel.

3. The carton of claim 2 wherein the first and second side end flaps are respectively attached to the first and second side panels at a fold line adjacent a first end of a respective curved edge portion.

4. The carton of claim 3 wherein the top end flap is foldably attached to the top panel at a fold line adjacent second ends of the curved edge portions.

5. The carton of claim 1 wherein the dispenser panel comprises at least a portion of the top panel and at least a portion of the top end flap.

6. The carton of claim 5 wherein the dispenser panel comprises at least a portion of the first side panel and at least a portion of the second side panel.

7. The carton of claim 1 wherein the carton comprises an actuation panel in the top panel for grasping the dispenser panel.

8. The carton of claim 7 wherein the actuation panel is foldably attached to the top panel by a curved fold line in the top panel, the actuation panel being further defined by at least a portion of the tear line in the top panel.

9. The carton of claim 1 wherein:

the closed end is a first closed end;

the at least two end flaps are first end flaps that are overlapped with respect to one another to form the closed first end; and the carton further includes at least two second end flaps, each of the second end flaps being respectively foldably attached to a respective panel of the plurality of panels, wherein the at least two second end flaps are overlapped with respect to one another to at least partially form a closed second end of the carton.

10. The carton of claim 9 wherein the dispenser is a first dispenser and the carton further includes a second dispenser for dispensing articles from the second closed end of the carton.

11. The carton of claim 1 in combination with a plurality of articles, the plurality of articles comprising containers that are arranged in at least two rows in the carton.

12. The combination of claim 11 wherein the at least two rows of containers comprises a first row having a first quantity of containers and a second row having a second quantity of containers, the first and second quantities being unequal.

13. A blank for forming a carton comprising:

a plurality of panels comprising a top panel, a bottom panel, a first side panel, and a second side panel;

at least two end flaps, each of the end flaps being respectively foldably attached to a respective panel of the plurality of panels, wherein the at least two end flaps are for being overlapped with respect to one another to thereby at least partially form a closed end of a carton formed from the blank, the at least two end flaps comprise a top end flap foldably attached to the top panel; and a dispenser panel that is at least partially defined by a tear line in the carton and is for being at least partially removed for at least further opening a dispenser opening in the closed end of the carton formed from the blank, the first side panel and second side panel having respective curved edge portions at an end of the blank, the top end flap having a curved portion with edges that are adjacent the curved edge portions of the first and second side panels to form a curved end profile at the closed end of the carton formed from the blank, the tear line comprising a tear line portion in the top end flap wherein the portion of the tear line in the top end flap extends across the edges of the top end flap and is generally perpendicular to the edges of the top end flap.

14. The blank of claim 13 wherein the curved edge portions are not directly connected to the at least two end flaps.

15. The blank of claim 13 wherein the at least two end flaps comprise a first side end flap foldably attached to the first side panel and a second side end flap foldably attached to the second side panel.

16. The blank of claim 15 wherein the first and second side end flaps are respectively attached to the first and second side panels at a fold line adjacent a first end of a respective curved edge portion.

17. The blank of claim 16 wherein the at least two end flaps further comprises a top end flap that is foldably attached to the top panel at a fold line adjacent second ends of the curved edge portions.

18. The carton of claim 1 wherein in at least one of the end flaps, the tear line forms a generally L-shaped portion for at least partially retaining the articles at the end of the carton.

19. The carton of claim 18 wherein the at least two end flaps comprises a bottom end flap foldably attached to the bottom panel.

20. The carton of claim 19 wherein the bottom end flap comprises a generally U-shaped cutout cooperating with respective L-shaped portions of the first side end flap and the second side end flap to at least partially define the dispenser opening.

21. The carton of claim 1 wherein the portion of the tear line in the top end flap divides the top end flap into a first portion and a second portion, the first portion comprising a portion of the dispenser panel.

22. The carton of claim 21 wherein the first portion is an upper portion and the second portion is a lower portion, the at least two end flaps comprise a first side end flap foldably attached to the first side panel and a second side end flap foldably attached to the second side panel, the first side end flap and the second side end flap being in overlapping relationship with and connected to the lower portion of the top end flap.

23. The carton of claim 22 wherein the upper portion of the top end flap is free from attachment to the first side end flap and the second side end flap.

24. The blank of claim 13 wherein the portion of the tear line in the top end flap divides the top end flap into a first portion and a second portion, the first portion comprising a portion of the dispenser panel.

25. The blank of claim 24 wherein the first portion is an upper portion and the second portion is a lower portion, the at least two end flaps comprise a first side end flap foldably attached to the first side panel and a second side end flap foldably attached to the second side panel, the first side end flap and the second side end flap being in overlapping relationship with and connected to the lower portion of the top end flap in the carton formed from the blank.

* * * * *